US012605588B2

(12) United States Patent
Lombard

(10) Patent No.: US 12,605,588 B2
(45) Date of Patent: Apr. 21, 2026

(54) RESISTANCE EXERCISE SLED WITH BAG POST

(71) Applicant: Hector Lombard, Coral Springs, FL (US)

(72) Inventor: Hector Lombard, Coral Springs, FL (US)

( * ) Notice: Subject to any disclaimer, the term of this patent is extended or adjusted under 35 U.S.C. 154(b) by 76 days.

(21) Appl. No.: 18/603,562

(22) Filed: Mar. 13, 2024

(65) Prior Publication Data

US 2025/0288856 A1 Sep. 18, 2025

(51) Int. Cl.

| | |
|---|---|
| ***A63B 21/00*** | (2006.01) |
| ***A63B 21/06*** | (2006.01) |
| ***A63B 23/04*** | (2006.01) |

(52) U.S. Cl.

CPC ..... *A63B 21/4035* (2015.10); *A63B 21/0618* (2013.01); *A63B 21/4034* (2015.10); *A63B 23/047* (2013.01)

(58) Field of Classification Search

CPC ..... A63B 21/4035; A63B 21/0618; A63B 21/4034; A63B 23/047; A63B 21/0051; A63B 21/0083; A63B 22/20; A63B 24/0087; A63B 2024/0093; A63B 2220/17; A63B 2220/20; A63B 2220/40; A63B 2220/51; A63B 2220/803; A63B 2220/833; A63B 21/008–0088; A63B 21/0058–0059; A63B 21/0052; A63B 21/005

See application file for complete search history.

(56) References Cited

U.S. PATENT DOCUMENTS

| | | | | |
|---|---|---|---|---|
| 3,062,548 A * | 11/1962 | Foster | A63B 69/34 473/445 |
| 3,424,458 A * | 1/1969 | Hopps, Jr. | A63B 69/34 473/443 |
| 5,980,398 A * | 11/1999 | Shingleton | A63B 69/34 473/445 |
| 6,261,195 B1 * | 7/2001 | Shingleton | A63B 69/34 473/441 |
| 6,761,650 B1 * | 7/2004 | Dettmann | A63B 69/34 473/445 |
| 7,416,412 B2 * | 8/2008 | Segrest | G09B 19/00 434/226 |

(Continued)

*Primary Examiner* — Megan Anderson
*Assistant Examiner* — Catrina A Letterman
(74) *Attorney, Agent, or Firm* — Mark C. Johnson; Johnson Dalal

(57) ABSTRACT

A resistance exercise sled with bag post that includes a base frame having wheels operably configured to generate resistance when placed in motion, thereby generating an intense leg exercise. The sled includes one or more handles for pushing the sled and a bag post assembly with a cantilevered central post frame member disposed in an erect orientation relative to the base frame, interposed between ends of the base frame, coupled to the base frame, having an upper central post end, a central post length separating the lower and upper central post ends and greater than a handle length of the handles and a horizontal post frame member disposed above the ends of the handle(s), with a horizontal post free end interposed between the frame length, and with at least one fastener configured to couple with and hang a punching bag adjacent to the cantilevered central post frame member.

8 Claims, 4 Drawing Sheets

(56) References Cited

U.S. PATENT DOCUMENTS

| | | | | |
|---|---|---|---|---|
| 7,527,568 | B2 * | 5/2009 | Joseph | A63B 69/32 473/422 |
| 7,658,699 | B1 * | 2/2010 | Johnson, Jr. | A63B 69/305 482/83 |
| 9,643,040 | B1 * | 5/2017 | Guerrero Diaz | A63B 23/047 |
| 9,789,376 | B1 * | 10/2017 | Henry | A63B 69/222 |
| 10,398,927 | B2 | 9/2019 | Baumler et al. | |
| 11,179,591 | B1 * | 11/2021 | Bazargan | A63B 69/34 |
| 11,724,150 | B2 | 8/2023 | Bazargan et al. | |
| 12,257,476 | B1 * | 3/2025 | Record | A63B 21/4005 |
| 2014/0073491 | A1 * | 3/2014 | Gilson | A63B 21/06 482/93 |
| 2018/0311522 | A1 * | 11/2018 | Schmidt | A63B 21/4009 |
| 2018/0326248 | A1 * | 11/2018 | Baumler | A63B 22/20 |
| 2019/0275364 | A1 * | 9/2019 | Saunders | A63B 21/0004 |
| 2020/0238127 | A1 * | 7/2020 | Wehrell | A63B 21/40 |
| 2024/0115903 | A1 * | 4/2024 | Patrick | A63B 22/20 |
| 2024/0245968 | A1 * | 7/2024 | Masters | A63B 71/0036 |

* cited by examiner

RESISTANCE EXERCISE SLED WITH BAG POST

FIELD OF THE INVENTION

The present invention relates generally to exercise devices and, more particularly, relates to a resistance exercise sled with incorporated posts thereon.

BACKGROUND OF THE INVENTION

Many users throughout the world exercise. One common device utilized for exercising includes a resistance exercise sled. Said another way and with reference to FIG. 1, the resistance exercise sled 100 is an exercise assembly that includes a base frame 102, a plurality of wheels 104*a-n*, one or more handle(s) 106*a-n* for grasping by the user and disposed in an erect configuration relative to the general orientation of the base frame 102, and operably configured to retain a plurality of weights thereon or emulate weight on the resistance exercise sled 100 by generating resistance to linear motion of the sled 100 (collectively referred to "resistance").

More specifically, many known resistance exercise sleds 100 include the above-referenced features like those depicted and discussed in Guerrero Diaz, U.S. Pat. No. 9,643,040, Baumler et al, U.S. Pat. No. 10,398,927, and Bazargan et al., U.S. Pat. No. 11,724,150, all of the foregoing references incorporated herein by reference. These references, however, are limited in design and versatility, particularly in regard to training or exercising for those users desiring to box, fight, or emulate the motions associated with the same.

Therefore, a need exists to overcome the problems with the prior art as discussed above.

SUMMARY OF THE INVENTION

The invention provides a resistance exercise sled with bag post that overcomes the hereinafore-mentioned disadvantages of the heretofore-known devices and methods of this general type and that includes a specially configured post for mounting one or more selectively removable punching bags.

With the foregoing and other objects in view, there is provided, in accordance with the invention, a resistance exercise sled with bag post that includes a base frame with a plurality of wheels rotatably coupled thereto, with a front frame end, with a rear frame end opposing the front frame end, a frame length separating the front and rear frame ends, and operably configured to generate resistance when placed in motion through rotation of the plurality of wheels, at least one cantilevered handle member disposed in an erect orientation relative to the base frame, of a slender configuration, disposed proximal to the front frame end, configured for grasping by a user, with a lower handle end, an upper handle end, a handle length separating the lower and upper handle ends, and coupled to the base frame along the handle length and a bag post assembly. The bag post assembly includes a cantilevered central post frame member disposed in an erect orientation relative to the base frame, interposed between the frame length, coupled to the base frame, having a lower central post end, having an upper central post end, a central post length separating the lower and upper central post ends and greater than the handle length and also includes a horizontal post frame member disposed above the upper handle end, coupled to the cantilevered central post frame member, with a horizontal post free end interposed between the frame length, and with at least one fastener configured to couple with and hang a punching bag adjacent to the cantilevered central post frame member.

In accordance with another feature, an embodiment of the present invention includes a tubular frame members of the base frame and a plate member directly coupled to two opposing tubular frame members of the base frame and directly coupled to the cantilevered central post frame member.

In accordance with a further feature of the present invention, the cantilevered central post frame member is of a slender configuration.

In accordance with yet another feature, an embodiment of the present invention also includes a first plurality of cantilevered handle members each disposed in an erect orientation relative to the base frame, of a slender configuration, disposed proximal to the front frame end, configured for grasping by a user, with a lower handle end, an upper handle end, a handle length separating the lower and upper handle ends, coupled to the base frame along the handle length, and at least partially parallel to one another along the handle length, wherein the cantilevered central post frame member and the horizontal post frame member are interposed between the first plurality of cantilevered handle members disposed proximal to the front frame end.

In accordance with an exemplary feature, an embodiment of the present invention also includes a second plurality of cantilevered handle members each disposed in an erect orientation relative to the base frame, of a slender configuration, disposed proximal to the rear frame end, configured for grasping by a user, with a lower handle end, an upper handle end, a handle length separating the lower and upper handle ends, coupled to the base frame along the handle length, and at least partially parallel to one another along the handle length, wherein the cantilevered central post frame member and the horizontal post frame member are interposed between the second plurality of cantilevered handle members disposed proximal to the rear frame end.

In accordance with a further feature of the present invention, the horizontal post frame member is coupled to the cantilevered central post frame member to form a T-shape with two horizontal post portions each having a free end thereon opposing one another and each with at least one fastener coupled thereto and configured to couple with and hang a punching bag adjacent to the cantilevered central post frame member.

In accordance with an additional feature of the present invention, the frame length is less than the central post length.

In accordance with an exemplary feature of the present invention, the base frame is operably configured to generate resistance when placed in motion through rotation of the plurality of wheels by having a plurality of selectively removable hand weight members coupled thereto or a friction-inducing member coupling configuration disposed in at least one of the plurality of wheels.

In accordance with a further feature of the present invention, the base frame is operably configured to generate resistance when placed in motion through rotation of the plurality of wheels by having a plurality of selectively removable hand weight members coupled thereto and also includes a cantilevered weight post configured to receive and retain the plurality of selectively removable hand weight members, wherein the horizontal post frame member is vertically aligned above the at least one fastener cantilevered weight post.

In accordance with a further feature of the present invention, the base frame is operably configured to generate user-selectable resistance when placed in motion through rotation of the plurality of wheels.

In accordance with an exemplary feature, an embodiment of the present invention also includes two sets of wheels rotatably coupled to the base frame and collectively defining a movement plane, wherein the cantilevered central post frame member is disposed in a substantially perpendicular orientation relative to the movement plane.

Although the invention is illustrated and described herein as embodied in a resistance exercise sled with bag post, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not necessarily drawn to scale but, where applicable, may be utilized to support a particular structural configuration or geometric relationship between components utilized in the assembly.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. As used herein, the term "wall" is intended broadly to encompass continuous structures, as well as, separate structures that are coupled together so as to form a substantially continuous external surface. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the posts attached to the base of the resistance exercise sled.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
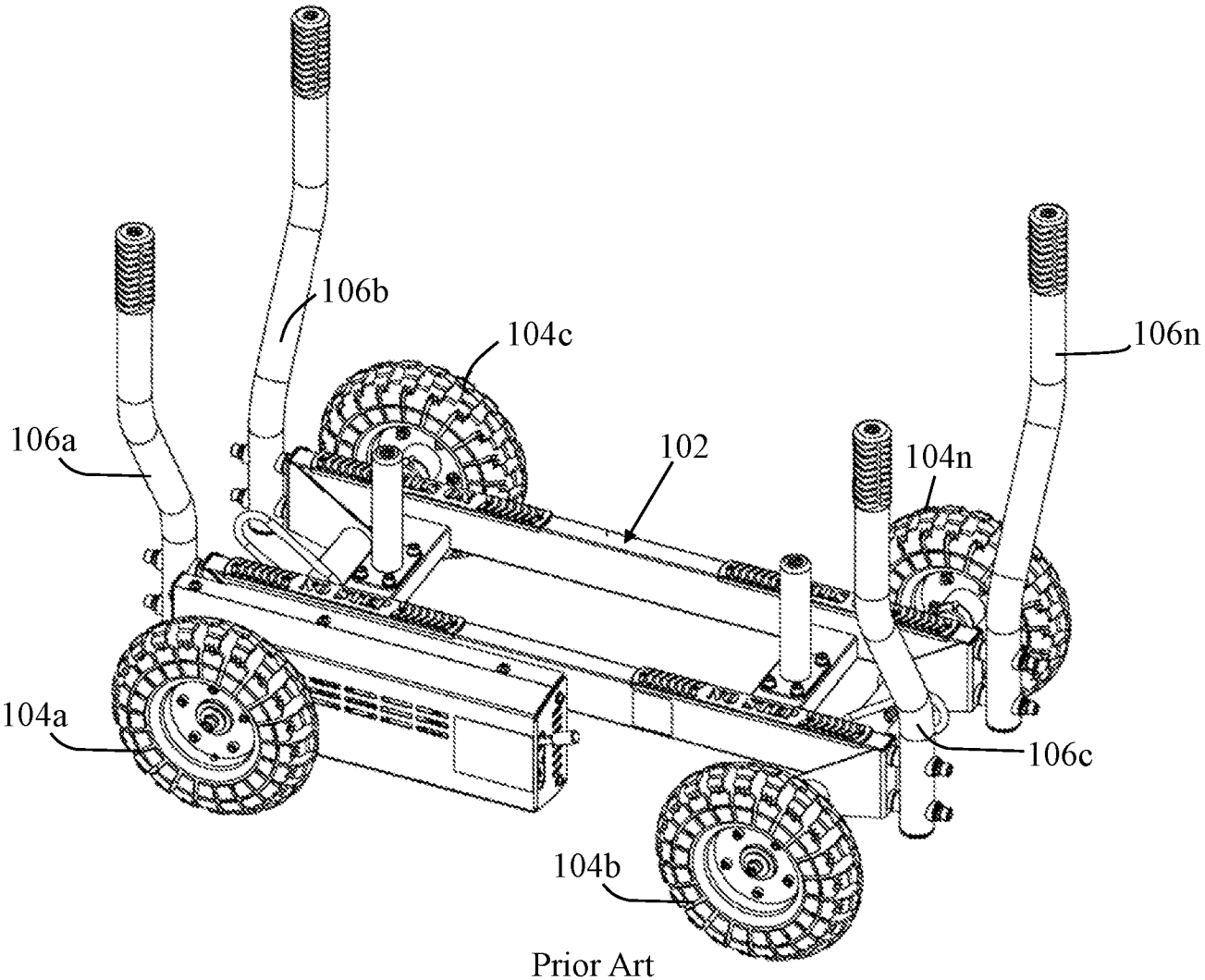
Prior Art FIG. 1
FIG. 1 is a perspective view of a prior-art resistance exercise sled.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 2:
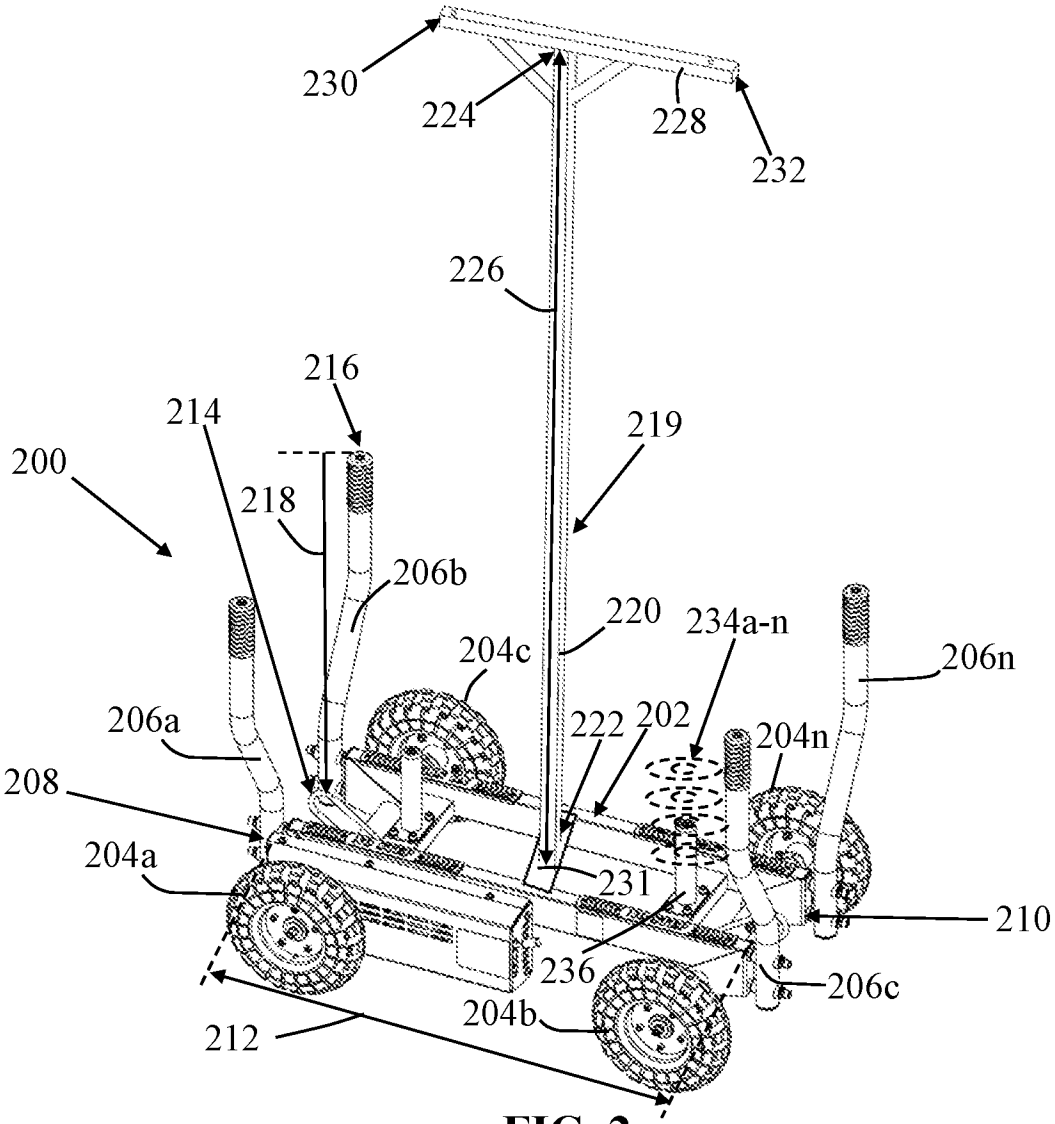
FIG. 2 is a perspective view of a resistance exercise sled with a bag post in accordance with one embodiment of the present invention.
Figure 3:
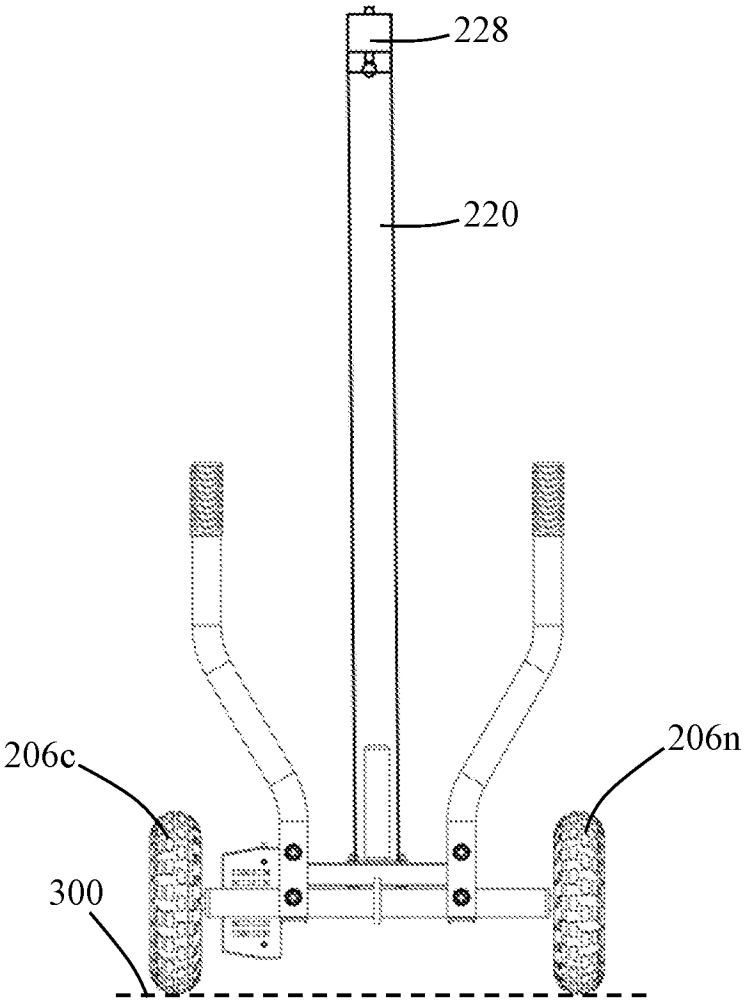
FIG. 3 is an elevational plan view of the resistance exercise sled with a bag post in FIG. 2.
Figure 4:
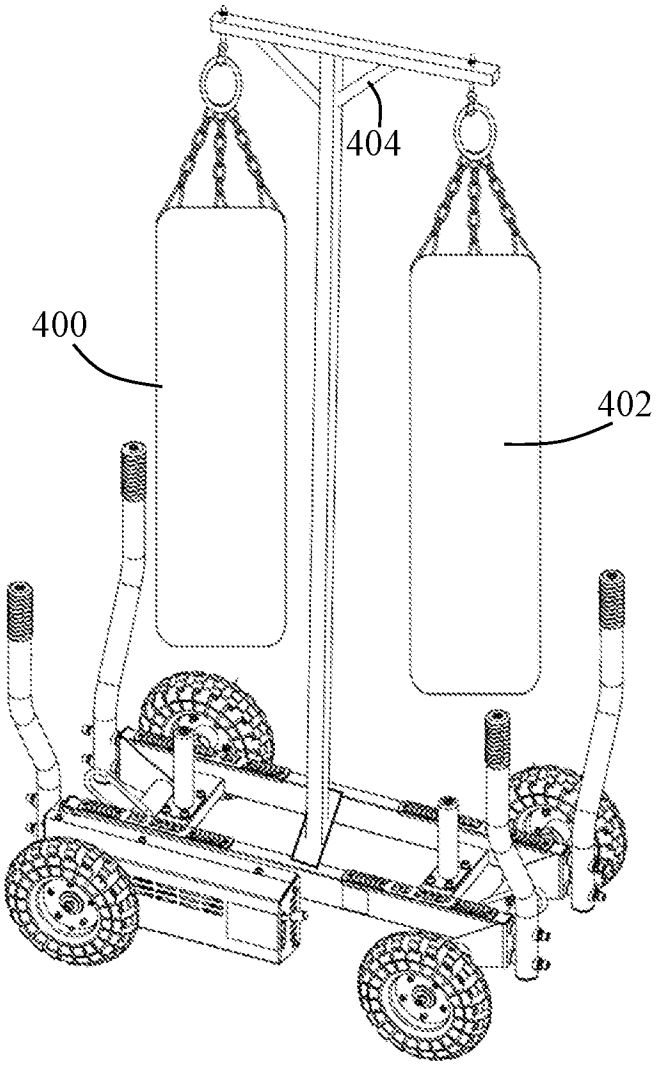
FIG. 4 is a perspective view of the resistance exercise sled with a bag post in FIG. 2 with two exemplary punching bags coupled thereto.

The present invention provides a novel and efficient resistance exercise sled with a bag post that provides versatility and safety not accomplished by known exercise resistance sleds. Referring now to FIGS. 2-4, one embodiment of the present invention is shown in perspective views. FIGS. 2-4 show several advantageous features of the present invention, but, as will be described below, the invention can be provided in several shapes, sizes, combinations of features and components, and varying numbers and functions of the components.

The first example of a resistance exercise sled with bag post 200 includes a base frame 202 with a plurality of wheels 204*a-n* rotatably coupled thereto, with a front frame end 208, with a rear frame end 210 opposing the front frame end, a frame length 212 separating the front and rear frame ends 208, 210, and operably configured to generate resistance when placed in motion through rotation of the plurality of wheels 204*a-n*, wherein "n" represents any number greater than one. It should be understood that terms such as, "front," "rear," "side," top," "bottom," and the like are indicated from the reference point of a viewer viewing parts of the assembly depicted in referenced figure.

The term "resistance" is defined above, but may include the base frame being configured to receive and retain a plurality of weight members (represented in FIG. 2) with numeral 234*a-n* or being operably configured to have a friction-inducing member coupling configuration in one of the plurality of wheels 204*a-n* (e.g., using brakes). To that end, the base frame 202 may generate resistance in any of the known methods and systems, including those described in Guerrero Diaz, U.S. Pat. No. 9,643,040, Baumler et al, U.S. Pat. No. 10,398,927, and Bazargan et al., U.S. Pat. No. 11,724,150. More specifically, the base frame 202 may be operably configured to generate resistance when placed in motion through rotation of the plurality of wheels 204*a-n* by having a plurality of selectively removable hand weight members 234*a-n* coupled thereto or a friction-inducing member coupling configuration disposed in at least one of the plurality of wheels 204*a-n*.

Beneficially, the assembly 200 may include one or more cantilevered handle member(s) 206*a-n* disposed in an erect orientation relative to the base frame 202, as depicted in the figures. The handle member(s) 206*a-n* are cantilevered because at least one end is free and unattached or uncoupled to an external structure. For example, each of the handle(s) are coupled to the base frame 202 at or near one end with, for example, one or more fasteners. Each of the handle member(s) 206*a-n* are of a slender configuration, i.e., a handle length is greater than the average diameter of the handle member 206. Each of the handle member(s) 206*a-n* are disposed proximal to either the front or rear frame end 208, 210 and are configured for grasping by a user, e.g., the diameter or surface curvature enables a user to grasp it (at least partially) with a single hand. In some embodiments, the handle members 206*a-n* will include an elastomeric friction-inducing material over or on the upper handle end 216 of the handle member 206. To that end, the handle members 206*a-m* may include a lower handle end 214, an upper handle end 216, a handle length 218 separating the lower and upper handle ends 214, 216, and are coupled to the base frame 202 along the handle length 218. In preferred embodiments, the handle members 206*a-n* are disposed at the terminal ends of the base frame 202 (as depicted in the figures). The term "proximal" is defined as at or near, within 10% of the overall length, of the referencing object. For example, in the handle members 206*a-n* are shown depicted at the terminal end of the base frame ends 208, 210, but may also be located within 10% over the frame length 212 to said ends 208, 210.

The bag post assembly 219 includes a cantilevered central post frame member 220 disposed in an erect orientation relative to the base frame 202. The cantilevered central post frame member 220 may be made with a substantially rigid material, e.g., stainless steel or aluminum, and formed in a tubular configuration to ensure strength and lighter weight than a casted or forged material. The cantilevered central post frame member 220 may be fastened to the base frame 202 with a base plate 231 that may extend laterally across the base frame 202 and may be directly coupled thereto with one or more fasteners or welding. More specifically, the base frame 202 may include a plurality of tubular frame members (as depicted in the figures) and the plate member 231 is directly coupled to two opposing tubular frame members of the base frame 202 and directly coupled to the cantilevered central post frame member 220. The orientation of the cantilevered central post frame member 220 may also be described in relation to the plurality of wheels 204*a-n*. More specifically and with reference to FIGS. 2-3, the sled 200 may include two sets of wheels 204*a-n* rotatably coupled to the base frame 202 and collectively defining a movement plane 300, wherein the cantilevered central post frame member 220 is disposed in a substantially perpendicular orientation (90°+/−10°) relative to the movement plane 300. Said another way, the wheels 204*a-n* define a level plane that the cantilevered central post frame member 220 is substantially perpendicular to.

The cantilevered central post frame member 220 is interposed between the frame length 212 and is preferably centrally located on the base frame 202, i.e., located within 10% of the centroid or center of mass of the base frame 202. The cantilevered central post frame member 220 has a lower central post end 222, an upper central post end 224, and a central post length 226 separating the lower and upper central post ends 222, 224 and that is greater than the handle length 218. The specially designed shape, size, and configuration of the cantilevered central post frame member 220 enables one or more punching bags to be safely and effectively utilized by a user when using the resistance exercise sled 200. Preferably, the cantilevered central post frame member 220 is also of a slender configuration to effectively use the sled as intended, i.e., not interfere with the intended operation of the sled without the bag post assembly 219. To that end, the frame length 212 is less than the central post length 226 to enable one or more punching bags (ranging from 20-200 cm in length). In one exemplary embodiment, the frame length 212 is approximately 90 cm and the central post length 226 is approximately 150 cm. The central post length 226 also cannot be too low because the horizontal post frame member 228 coupled thereto may be a safety hazard to the user.

The bag post assembly 219 also includes a horizontal post frame member 228 disposed above, preferably completely above, the upper handle end 216 of each of the handle(s) 206*a-n* utilized on the sled 200. The horizontal post frame member 228 is preferably made with the same material and formed into the shape configuration as the central post frame member 220. The horizontal post frame member 228 is coupled to the cantilevered central post frame member 220 with one or more fasteners, welding, etc. The horizontal post frame member 228 includes one or more horizontal post free ends 230, 232 that are beneficially interposed between the frame length 212. The horizontal post frame member 228 also includes one or more fastener(s) configured to couple with and hang a punching bag (e.g., bags 400, 402) adjacent to the cantilevered central post frame member 220. This can be seen best in FIG. 4. Said another way, the horizontal post frame member 228 is structurally configured and coupled to the central post frame member 220 to orient the punching bag(s) 400, 402 in a parallel orientation with the cantilevered central post frame member 220. The horizontal post frame member 228 may be structurally supported with one or more trust member(s) (e.g., trust member 404) to support the weight of the bags 400, 402 when coupled to the horizontal post frame member 228, particularly as the sled 200 is intended to be utilized in motion.

In one embodiment, the sled 200 includes a first plurality of cantilevered handle members 206*a-b* each disposed in an erect orientation relative to the base frame 202, of a slender configuration, disposed proximal to the front frame end 208, configured for grasping by a user, with a lower handle end 214, an upper handle end 216, a handle length 218 separating the lower and upper handle ends 214, 216, coupled to the base frame 202 along the handle length, and at least partially parallel to one another along the handle length 218. In preferred embodiments, the sled 200 includes a second plurality of cantilevered handle members 206*c-n* with the same features, configuration and orientation as the first plurality of cantilevered handle members 206*a-b*, with the exception that the second plurality of cantilevered handle members 206*c-n* are disposed proximal to the rear frame end 210 instead of the front frame end 208. The cantilevered central post frame member 220 and the horizontal post frame member 228 are interposed between the first and/or second plurality of cantilevered handle members 206*a-b*. Said differently, when viewed from the side of the sled 200 as depicted in FIG. 3, the cantilevered central post frame member 220 and the horizontal post frame member 228 are located vertically between the handle members 206*a-n*.

In preferred embodiments, the horizontal post frame member 228 is coupled to the cantilevered central post frame member 220 to form a T-shape with two horizontal post portions each having a free end 230, 232 thereon opposing one another. This configuration beneficially enables two bags 400, 402 on each side of the sled 200, thereby enabling a user to push the sled 200 with the handles 206*a-n* on either side and utilize a bag on each side (that may also be of varying deformability or material). The sections of the horizontal post frame member 228 may also include at least one fastener (e.g., a hook, carabiner, clip, ring, etc.) coupled thereto and configured to couple with and hang a punching bag adjacent to the cantilevered central post frame member 220.

In one embodiment, the base frame 202 is operably configured to generate resistance when placed in motion through rotation of the plurality of wheels 204*a-n* by having a plurality of selectively removable hand weight members 234*a-n* coupled thereto and includes the cantilevered weight post 236 configured to receive and retain the plurality of selectively removable hand weight members 234*a-n*, wherein the horizontal post frame member 228 is vertically aligned above the at least one fastener cantilevered weight post 236. Said another way, the base frame 202 is operably configured to generate user-selectable resistance when placed in motion through rotation of the plurality of wheels 204*a-n* (e.g., by adding or removing weights, adjusting friction with the breaks, etc.). The one or more one fastener (s), e.g., threaded bolt, screw, etc., may be configured to be directly above the cantilevered weight post 236 to enable the bag weight to be distributed equally on the base frame 202.

Although a specific order of executing the process steps has been described or shown, the order of executing the steps may be changed relative to the order shown in certain embodiments. Also, two or more steps shown or described as occurring in succession may be executed concurrently or with partial concurrence in some embodiments. Certain steps may also be omitted for the sake of brevity. In some embodiments, some or all of the process steps can be combined into a single process.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A resistance exercise sled with bag post comprising:

a base frame with a plurality of wheels rotatably coupled thereto, with a front frame end, with a rear frame end opposing the front frame end, a frame length separating the front frame end and the rear frame end, and operably configured to generate resistance when placed in motion through rotation of the plurality of wheels;

at least one cantilevered handle member disposed in an erect orientation relative to the base frame, of a slender configuration, disposed proximal to the front frame end, configured for grasping by a user, with a lower handle end, an upper handle end, a handle length separating the lower handle end and the upper handle end, and coupled to the base frame along the handle length; and a bag post assembly with:

a cantilevered central post frame member disposed in an erect orientation relative to the base frame, interposed between the frame length, coupled to the base frame, having a lower central post end, having an upper central post end, a central post length separating the lower central post end and the upper central post end and greater than the handle length, the frame length is less than the central post length; and a horizontal post frame member disposed above the upper handle end, coupled to the cantilevered central post frame member to form a T-shape with the horizontal post frame member oriented in a direction spanning from the front frame end to the rear frame end, and with two horizontal post portions each having a horizontal post free end interposed between the frame length and with at least one fastener configured to couple with and hang a punching bag adjacent to the cantilevered central post frame member and over the base frame.

2. The resistance exercise sled with bag post according to claim 1, wherein the at least one cantilevered handle member further comprises:

a first plurality of cantilevered handle members each disposed in an erect orientation relative to the base frame, of a slender configuration, disposed proximal to the front frame end, configured for grasping by a user, with a lower handle end, an upper handle end, a handle length separating the lower handle end and the upper handle end, coupled to the base frame along the handle length, and at least partially parallel to one another along the handle length, wherein the cantilevered central post frame member and the horizontal post frame member are interposed between the first plurality of cantilevered handle members disposed proximal to the front frame end.

3. The resistance exercise sled with bag post according to claim 2, further comprising:

a second plurality of cantilevered handle members not forming part of the first plurality of cantilevered handle members and each disposed in an erect orientation relative to the base frame, of a slender configuration, disposed proximal to the rear frame end, configured for grasping by a user, with a lower handle end, an upper handle end, a handle length separating the lower handle end and the upper handle end, coupled to the base frame along the handle length, and at least partially parallel to one another along the handle length, wherein the cantilevered central post frame member and the horizontal post frame member are interposed between the second plurality of cantilevered handle members disposed proximal to the rear frame end.

4. The resistance exercise sled with bag post according to claim 1, wherein the base frame is operably configured to generate resistance when placed in motion through rotation of the plurality of wheels by having a plurality of selectively removable hand weight members coupled thereto or a friction-inducing member coupled to at least one of the plurality of wheels.

5. The resistance exercise sled with bag post according to claim 4, wherein the base frame is operably configured to generate resistance when placed in motion through rotation of the plurality of wheels by having the plurality of selectively removable hand weight members coupled thereto and further comprising:

a cantilevered weight post configured to receive and retain the plurality of selectively removable hand weight members, wherein the horizontal post frame member is vertically aligned above the cantilevered weight post.

6. The resistance exercise sled with bag post according to claim 1, further comprising:

two opposing tubular frame members of the base frame; and a plate member directly coupled to the two opposing tubular frame members of the base frame and directly coupled to the cantilevered central post frame member.

7. The resistance exercise sled with bag post according to claim 1, wherein the cantilevered central post frame member is of a slender configuration.

8. The resistance exercise sled with bag post according to claim 1, wherein the base frame is operably configured to generate user-selectable resistance when placed in motion through rotation of the plurality of wheels.

* * * * *